US012042047B1

(12) United States Patent
Toner

(10) Patent No.: US 12,042,047 B1
(45) Date of Patent: Jul. 23, 2024

(54) ADJUSTABLE MOUNTING BRACKET FOR DRAWER FACES

(71) Applicant: Jeffrey Toner, Wadmalaw Island, SC (US)

(72) Inventor: Jeffrey Toner, Wadmalaw Island, SC (US)

( * ) Notice: Subject to any disclaimer, the term of this patent is extended or adjusted under 35 U.S.C. 154(b) by 177 days.

(21) Appl. No.: 17/867,772

(22) Filed: Jul. 19, 2022

(51) Int. Cl.
*A47B 88/956* (2017.01)

(52) U.S. Cl.
CPC ..... *A47B 88/956* (2017.01)

(58) Field of Classification Search
CPC ..... A47B 88/956; A47B 88/95
See application file for complete search history.

(56) References Cited

U.S. PATENT DOCUMENTS

| | | | | |
|---|---|---|---|---|
| 4,705,328 | A | 11/1987 | Rock | |
| 5,375,923 | A | 12/1994 | Hall | |
| 6,695,420 | B2 | 2/2004 | Ackerman | |
| 7,625,051 | B1 | 12/2009 | Kim | |
| D690,065 | S | 9/2013 | Schoenster | |
| 10,330,370 | B2 | 6/2019 | Choi | |
| 2006/0082269 | A1 | 4/2006 | DeCurtis | |
| 2011/0167604 | A1 | 7/2011 | Stewart | |
| 2012/0286116 | A1* | 11/2012 | Gasser | A47B 88/956 248/221.11 |
| 2014/0239787 | A1* | 8/2014 | Mensa' | A47B 88/956 312/348.4 |
| 2015/0305499 | A1* | 10/2015 | Rioja Calvo | A47B 88/956 403/408.1 |
| 2015/0359334 | A1* | 12/2015 | Salice | A47B 88/95 312/348.4 |
| 2019/0298059 | A1* | 10/2019 | Chen | A47B 88/994 |
| 2021/0307512 | A1* | 10/2021 | Lin | A47B 88/427 |
| 2022/0061525 | A1* | 3/2022 | Chen | A47B 88/42 |

FOREIGN PATENT DOCUMENTS

WO 2014198819 12/2014

* cited by examiner

*Primary Examiner* — Daniel J Rohrhoff

(57) ABSTRACT

The adjustable mounting bracket for drawer faces is configured for use with a drawer pan. The adjustable mounting bracket for drawer faces secures a decorative face to the lateral face of the drawer pan. The adjustable mounting bracket for drawer faces forms a jig that adjusts the attachment position of the decorative face on the lateral face of the drawer pan. The adjustable mounting bracket for drawer faces adjusts the decorative face in the lateral and vertical directions. The adjustable mounting bracket for drawer faces comprises a drawer mount and a pedestal mount. The pedestal mount secures the drawer mount to the drawer pan. The drawer mount secures the decorative face to the lateral face of the drawer pan.

15 Claims, 6 Drawing Sheets

ADJUSTABLE MOUNTING BRACKET FOR DRAWER FACES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fastening devices for cabinet drawer slides and guides. (A47B88/43)

SUMMARY OF INVENTION

The adjustable mounting bracket for drawer faces is configured for use with a drawer pan. The adjustable mounting bracket for drawer faces secures a decorative face to the lateral face of the drawer pan. The adjustable mounting bracket for drawer faces forms a jig that adjusts the attachment position of the decorative face on the lateral face of the drawer pan. The adjustable mounting bracket for drawer faces adjusts the decorative face in the lateral and vertical directions. The adjustable mounting bracket for drawer faces comprises a drawer mount and a pedestal mount. The pedestal mount secures the drawer mount to the drawer pan. The drawer mount secures the decorative face to the lateral face of the drawer pan.

These together with additional objects, features and advantages of the adjustable mounting bracket for drawer faces will be readily apparent to those of ordinary skill in the art upon reading the following detailed description of the presently preferred, but nonetheless illustrative, embodiments when taken in conjunction with the accompanying drawings.

In this respect, before explaining the current embodiments of the adjustable mounting bracket for drawer faces in detail, it is to be understood that the adjustable mounting bracket for drawer faces is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adjustable mounting bracket for drawer faces.

It is therefore important that the claims be regarded as including such equivalent construction insofar as they do not depart from the spirit and scope of the adjustable mounting bracket for drawer faces. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
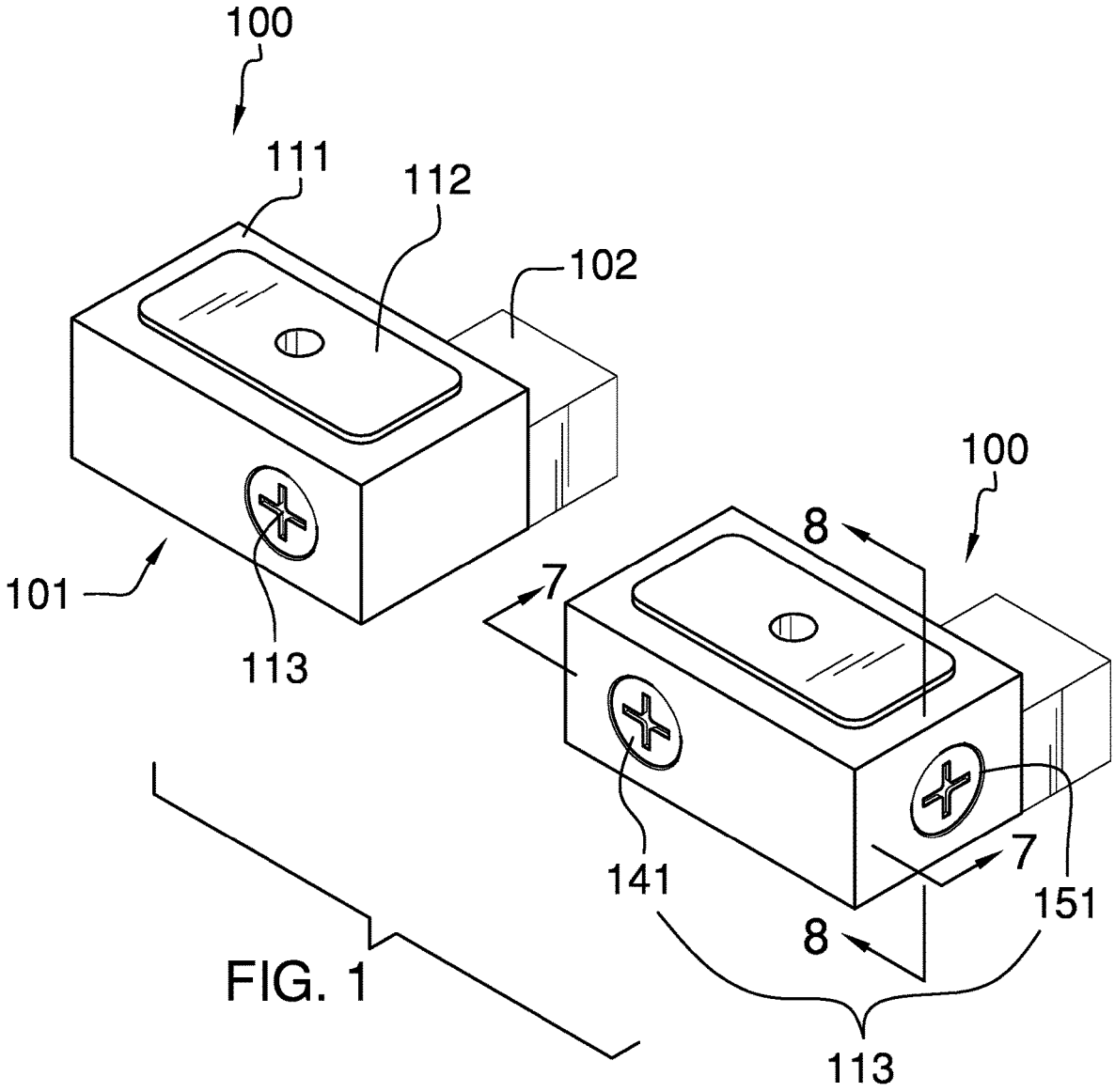
FIG. 1 is a perspective view of an embodiment of the disclosure.
Figure 2:
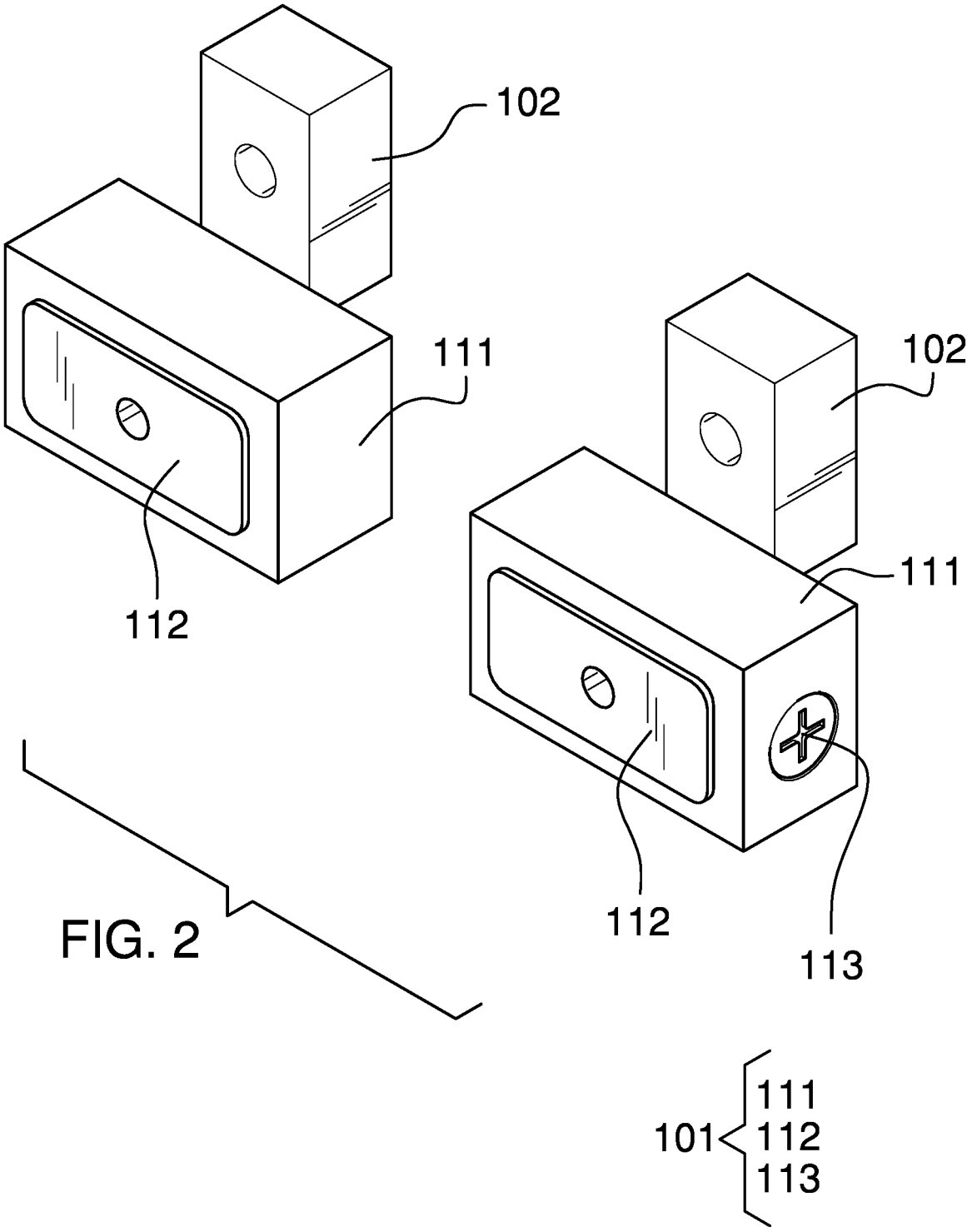
FIG. 2 is a perspective view of an embodiment of the disclosure.
Figure 3:
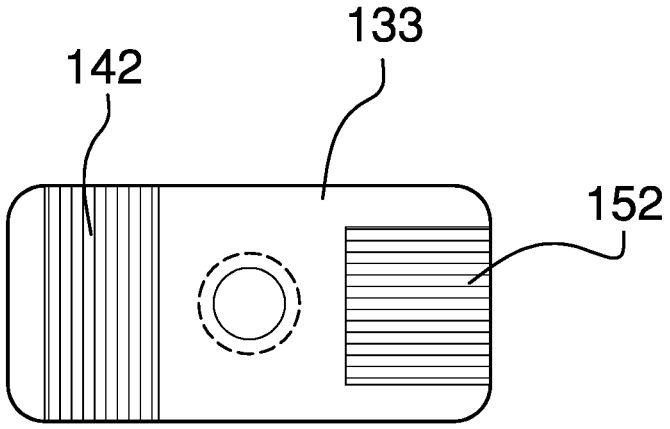
FIG. 3 is a detail view of an embodiment of the disclosure.
Figure 4:
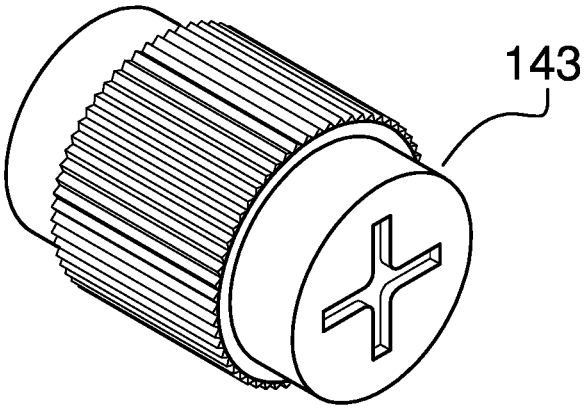
FIG. 4 is a detail view of an embodiment of the disclosure.
Figure 5:
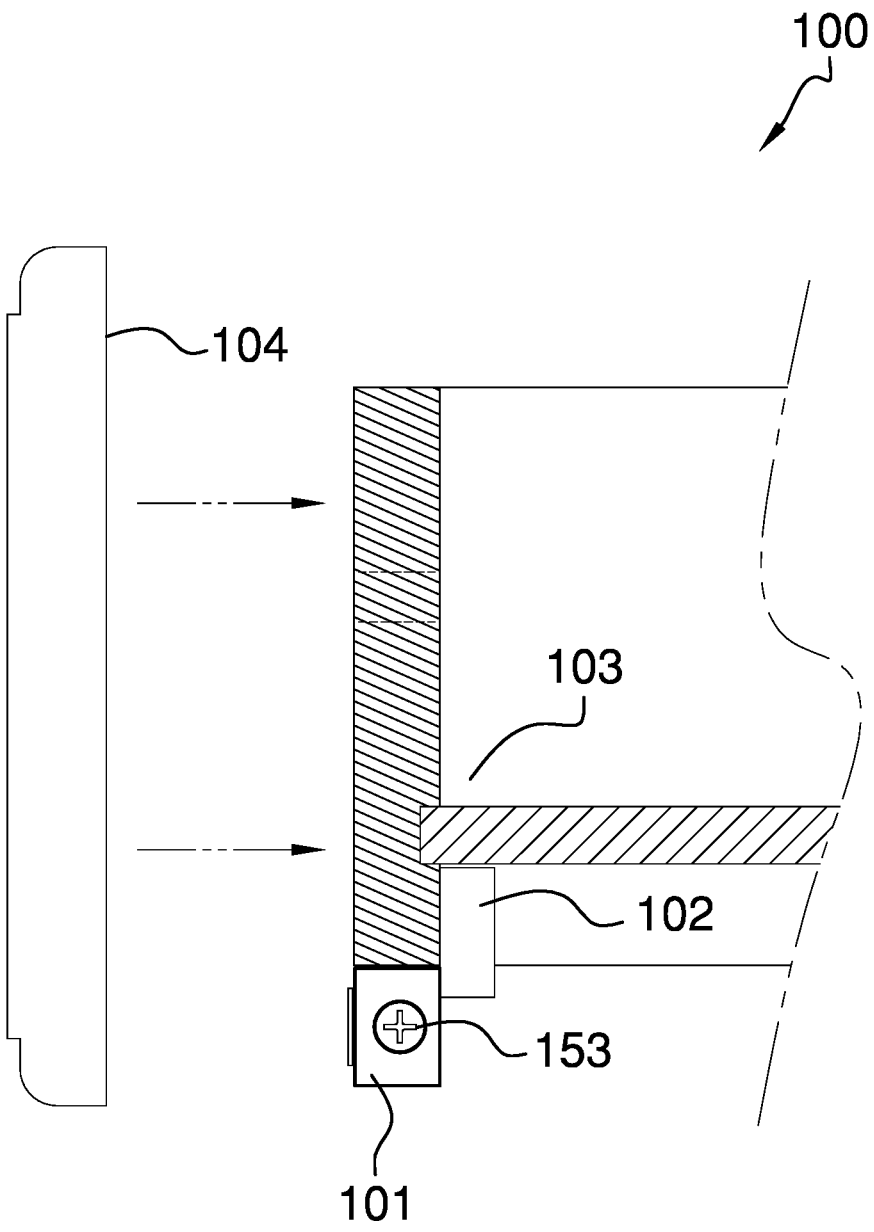
FIG. 5 is an in-use view of an embodiment of the disclosure.
Figure 6:
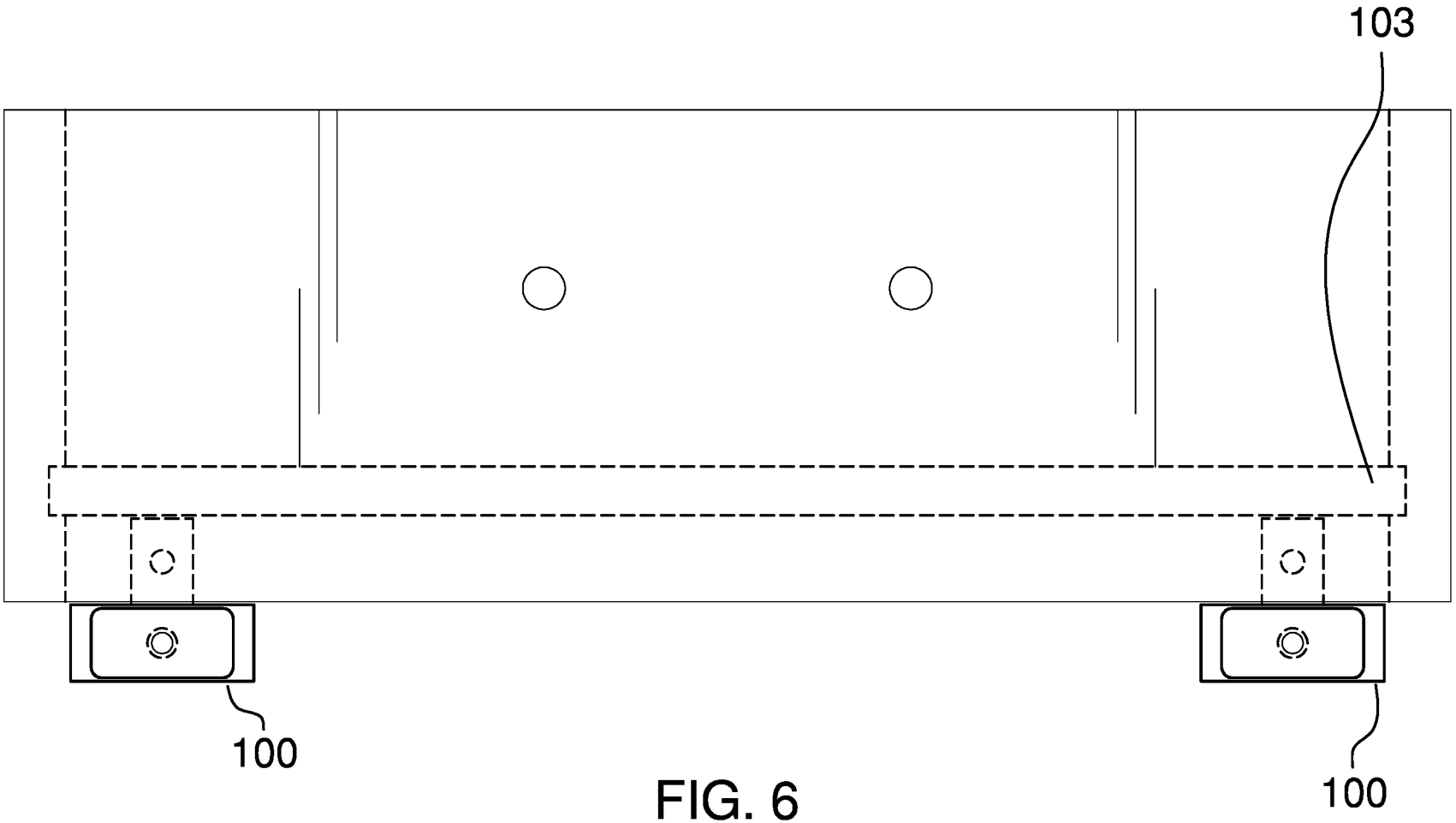
FIG. 6 is an in-use view of an embodiment of the disclosure.
Figure 7:
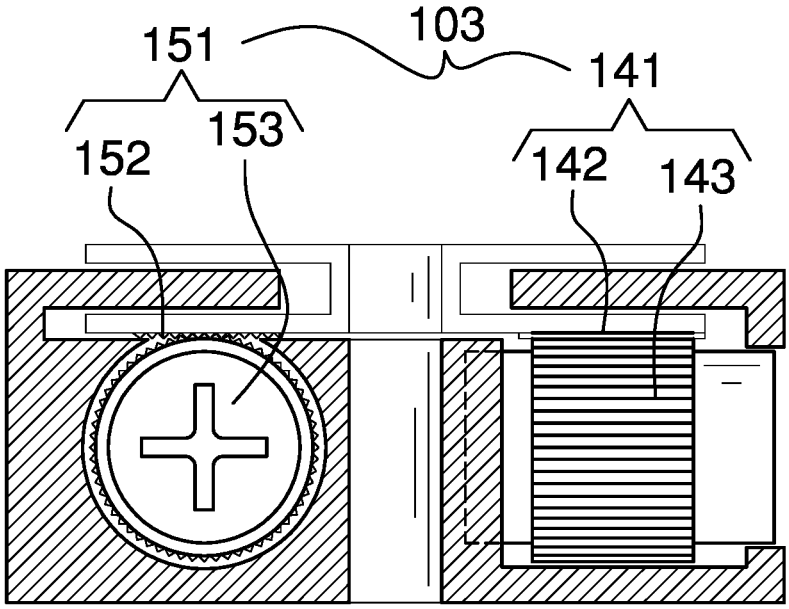
FIG. 7 is a cross-sectional view of an embodiment of the disclosure across 7-7 as shown in FIG. 1.
Figure 8:
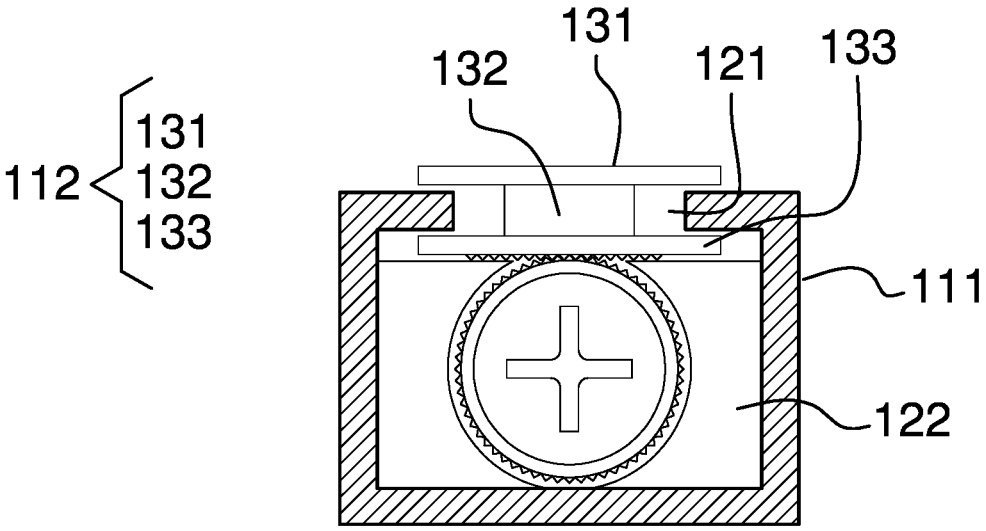
FIG. 8 is a cross-sectional view of an embodiment of the disclosure across 8-8 as shown in FIG. 1.

Detailed reference will now be made to one or more potential embodiments of the disclosure, which are illustrated in FIGS. 1 through 8.

The adjustable mounting bracket for drawer faces 100 (hereinafter invention) is configured for use with a drawer pan 103. The invention 100 secures a decorative face 104 to the lateral face of the drawer pan 103. The invention 100 forms a jig that adjusts the attachment position of the decorative face 104 on the lateral face of the drawer pan 103. The invention 100 adjusts the decorative face 104 in the lateral and vertical directions. The invention 100 comprises a drawer mount 101 and a pedestal mount 102. The pedestal mount 102 secures the drawer mount 101 to the drawer pan 103. The drawer mount 101 secures the decorative face 104 to the lateral face of the drawer pan 103.

The drawer pan 103 is a prism shaped structure. The drawer pan 103 has a pan shape. The drawer pan 103 forms a containment space used for the storage of one or more domestic articles. This disclosure assumes that the drawer pan 103 slides into and out of the drawer box of a cabinet.

The decorative face 104 is a decorative structure. The decorative face 104 attaches to the lateral face of the pan shape of the drawer pan 103 that is proximal to the opening of the drawer box when the drawer pan 103 is fully inserted into the drawer box. The decorative face 104 attaches to the drawer pan 103 such that the decorative face 104 encloses the drawer box that receives the drawer pan 103.

The pedestal mount 102 is a fastening device. The pedestal mount 102 is a load bearing device. The pedestal mount 102 physically attaches the drawer mount 101 to the drawer pan 103. The pedestal mount 102 permanently attaches to the drawer pan 103. The drawer mount 101 permanently attaches to the pedestal mount 102. In the first potential embodiment of the disclosure, the pedestal mount 102 screws into the drawer pan 103.

The drawer mount 101 is a fastening device. The drawer mount 101 secures the decorative face 104 to the lateral face of the drawer pan 103 that leads the drawer pan 103 out of the drawer box when the drawer pan 103 is removed from the drawer box. The drawer mount 101 is an adjustable structure. By adjustable structure is meant that that the position of the decorative face 104 relative to the drawer pan 103 can be adjusted in a vertical direction after the drawer mount 101 has attached the decorative face 104 to the drawer pan 103. By adjustable structure is further meant that that the position of the decorative face 104 relative to the drawer pan 103 can be adjusted in a lateral direction after the drawer mount 101 has attached the decorative face 104 to the drawer pan 103.

The drawer mount 101 comprises a dm housing 111, a dm plate 112, and a plurality of worm drives 113. The dm plate 112 and the plurality of worm drives 113 attach to the dm housing 111. The dm housing 111 is a prism shaped structure. The dm housing 111 is a rigid structure. The dm housing 111 is a hollow structure. The dm housing 111 contains the plurality of worm drives 113. The dm housing 111 further comprises a flange aperture 121 and a containment space 122.

The flange aperture 121 is an aperture that is formed through the exterior surface of the dm housing 111. The dm plate 112 attaches to the dm housing 111 by inserting through the flange aperture 121. The flange aperture 121 is sized such that the position of the dm plate 112 within the flange aperture 121 is adjustable.

The containment space 122 is a negative space that is formed within the dm housing 111. The containment space 122 contains the plurality of worm drives 113 within the dm housing 111. The containment space 122 contains a portion of the dm plate 112 within the dm housing 111.

The dm plate 112 mounts on the dm housing 111. The dm housing 111 is formed with all the apertures and form factors necessary for the operation of the plurality of worm drives 113. The dm housing 111 physically attaches to the pedestal mount 102. The dm housing 111 permanently attaches the dm plate 112 and the plurality of worm drives 113 to the pedestal mount 102. The dm plate 112 is a rigid structure. The dm plate 112 has the shape of an i-beam. The dm plate 112 secures the decorative face 104 to the drawer mount 101.

The dm plate 112 physically attaches to each worm drive selected from the plurality of worm drives 113. The plurality of worm drives 113 attach to the dm plate 112. The plurality of worm drives 113 adjust the position of the dm plate 112 relative to the dm housing 111. The position of the decorative face 104 relative to the drawer pan 103 adjusts by adjusting the position of the dm plate 112 relative to the dm housing 111.

The dm plate 112 further comprises an exterior flange 131, a web 132, and an interior flange 133.

The exterior flange 131 is a disk shaped structure. The exterior flange 131 forms a flange of the i-beam structure of the dm plate 112. The exterior flange 131 forms the structure of the dm plate 112 that extends beyond the exterior surfaces of the dm housing 111. The exterior flange 131 physically attaches to the decorative face 104. The surface area of the faces of the disk structure of the exterior flange 131 is greater than the surface area of the flange aperture 121 such that the exterior flange 131 will not pass through the flange aperture into the containment space 122.

The interior flange 133 is a disk shaped structure. The interior flange 133 forms a flange of the i-beam structure of the dm plate 112. The interior flange 133 forms the structure of the dm plate 112 that is contained within the containment space 122 of the dm housing 111. The plurality of worm drives 113 physically attach to the interior flange 133. Each worm drive selected from the plurality of worm drives 103 physically moves the interior flange 133 to move the position of the dm plate 112 relative to the dm housing 111. The surface area of the faces of the disk structure of the interior flange 133 is greater than the surface area of the flange aperture 121 such that the exterior flange 131 will not pass out of the dm housing 111 through the flange aperture 121.

The web 132 is a rigid structure that attaches the exterior flange 131 to the interior flange 133. The web 132 inserts through the flange aperture 121 of the dm housing 111. The web 132 transfers the motion of the interior flange 133 to move the position of the exterior flange 131 relative to the dm housing 111. The area of the cross section of the web 132 is lesser than the surface area of the flange aperture 121 such that the web 132 moves freely within the flange aperture 121.

Each worm drive selected from the plurality of worm drives 103 is a worm drive. The worm drive is defined elsewhere in this disclosure. Each selected worm drive attaches to the interior flange 133 of the dm plate 112. Each selected worm drive attaches to the interior flange 133 such that the position of the interior flange 133 relative to the dm housing 111 is adjustable. The plurality of worm drives 113 provide the motive forces necessary to change the position of the dm plate 112 relative to the dm housing 111. The plurality of worm drives 113 form the mechanical structure used to adjust the position of the decorative face 104 relative to the drawer pan 103. The plurality of worm drives 113 adjust the position of the decorative face 104 by adjusting the position of the dm plate 112 relative to the dm housing 111. The plurality of worm drives 113 further comprises a vertical worm drive 141 and a lateral worm drive 151.

The vertical worm drive 141 is a worm drive. The vertical worm drive 141 is the worm drive selected from the plurality of worm drives 113 that moves the decorative face 104 relative to the drawer pan 103 in the vertical direction. The vertical worm drive 141 moves the decorative face 104 by moving the dm plate relative to the dm housing 111. The vertical worm drive 141 further comprises a vertical drive plate 142 and a vertical rotating drive cylinder 143.

The vertical drive plate 142 is a toothed structure. The vertical drive plate 142 is a disk shaped structure that is formed with a gear structure. The vertical drive plate 142 mounts on the congruent end of the disk structure of the interior flange 133 that is distal from the exterior flange 131.

The vertical rotating drive cylinder 143 is a prism shaped structure. The vertical rotating drive cylinder 143 has a cylindrical shape. The vertical rotating drive cylinder 143 is a rotating structure. The vertical rotating drive cylinder 143 rotates around a center of rotation that aligns with the center axis of the cylinder structure of the vertical rotating drive cylinder 143. The vertical rotating drive cylinder 143 is manually rotated using a screwdriver. The vertical rotating drive cylinder 143 further comprises an exterior gear structure that is formed on the lateral face of the cylindrical structure of the vertical rotating drive cylinder 143.

The exterior gear structure of the vertical rotating drive cylinder 143 meshes with the gear structure of the vertical drive plate 142 such that the rotation of the vertical rotating drive cylinder 143 moves the position of the vertical drive plate 142 relative to the vertical rotating drive cylinder 143. The rotation of the vertical rotating drive cylinder 143 moves the vertical drive plate 142 which in turn moves the position of the dm plate 112 within the flange aperture 121.

The lateral worm drive 151 is a worm drive. The lateral worm drive 151 is the worm drive selected from the plurality of worm drives 113 that moves the decorative face 104 relative to the drawer pan 103 in the lateral direction. The lateral worm drive 151 moves the decorative face 104 by moving the dm plate 112 relative to the dm housing 111. The lateral worm drive 151 further comprises a lateral drive plate 152 and a lateral rotating drive cylinder 153.

The lateral drive plate 152 is a toothed structure. The lateral drive plate 152 is a disk shaped structure that is formed with a gear structure. The lateral drive plate 152 mounts on the congruent end of the disk structure of the interior flange 133 that is distal from the exterior flange 131.

The lateral rotating drive cylinder 153 is a prism shaped structure. The lateral rotating drive cylinder 153 has a cylindrical shape. The lateral rotating drive cylinder 153 is a rotating structure. The lateral rotating drive cylinder 153 rotates around a center of rotation that aligns with the center axis of the cylinder structure of the lateral rotating drive cylinder 153. The lateral rotating drive cylinder 153 is manually rotated using a screwdriver. The lateral rotating drive cylinder 153 further comprises an exterior gear structure that is formed on the lateral face of the cylindrical structure of the lateral rotating drive cylinder 153.

The exterior gear structure of the lateral rotating drive cylinder 153 meshes with the gear structure of the lateral drive plate 152 such that the rotation of the lateral rotating drive cylinder 153 moves the position of the lateral drive plate 152 relative to the lateral rotating drive cylinder 153. The rotation of the lateral rotating drive cylinder 153 moves the lateral drive plate 152 which in turn moves the position of the dm plate 112 within the flange aperture 121.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bracket: As used in this disclosure, a bracket is a mechanical structure that attaches a second structure to a first structure such that the load path of the second structure is fully transferred to the first structure.

Cabinet: As used in this disclosure, a cabinet is a furniture item that is used to store objects. A cabinet is usually equipped with drawers, shelves, or a combination of both.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Decorative: As used in this disclosure, decorative is an adjective that refers to a first object or item that is used with a second object or item of the purpose of making the second object or item more interesting or attractive. Decorative will generally, but not necessarily, implies making the second object or item more visually attractive.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Domestic Article: As used in this disclosure, a domestic article is an item or object: 1) that is commonly found within a household; or, 2) that is commonly carried or worn by a person. Examples of domestic articles include, but are not limited to, furniture, kitchen appliances, clothing, keys and key fobs, personal data devices, glasses, remote controls, or personal storage items such as purses, briefcases, wallets, or cases.

Drawer: As used in this disclosure, a drawer is a pan shaped structure that is designed to slide into and out of a larger object. The pan shaped structure is referred to as the drawer pan. The negative space the drawer pan slides into and out of is referred to as the drawer box.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Gear: As used in this disclosure, a gear is a toothed wheel, cylinder, or other toothed mechanical element that is used to transmit motion, a change of speed, or a change of direction to second toothed wheel, cylinder, or other toothed mechanical element.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

I-Beam: As used in this disclosure, an I-beam is a beam, generally made of iron or steel, which has a cross-section that forms an "I" shape. The I-beam is a well-known and commercially available beam. An I-beam comprises a first flange, a second flange, and a web.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Lateral: As used in this disclosure, the term lateral refers to motion in a direction that is perpendicular to the direction of the force of gravity. Movement in a lateral direction is often called "sideways" movement.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mount: As used in this disclosure, a mount is a mechanical structure that attaches or incorporates a first object to a second object.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Recess: As used in this disclosure, a recess is a disk-shaped negative space that is formed in a surface. The recess forms a pan shaped. The recess is sized to receive an object such that a portion of the object is below the plane of the surface in which the recess is formed.

Rigid Structure: As used in this disclosure, a rigid structure is a solid structure formed from an inelastic material that resists changes in shape. A rigid structure will permanently deform as it fails under a force. See bimodal flexible structure.

Rotation: As used in this disclosure, rotation refers to the cyclic movement of an object around a fixed point or fixed axis. The verb of rotation is to rotate.

Slide: As used in this disclosure, slide is a verb that refers to an object that is transported along a surface while in continuous contact with the surface. An object being transported along a surface with wheels cannot be said to be sliding. A slide over a short distance is referred to as a slip.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Worm Drive: As used in this disclosure, a worm drive refers to a mechanical arrangement that comprises a rotating drive cylinder and a drive plate. The rotating drive cylinder further comprises an exterior gear structure on the lateral face of the cylinder structure of the rotating drive cylinder. The drive plate further comprises a gear structure that meshes with the exterior gear structure of the rotating drive cylinder. The rotation of the rotating drive cylinder moves the drive plate in a linear fashion. Worm drives are also referred to as worm gears.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An adjustable mounting bracket for drawer faces comprising a drawer mount and a pedestal mount;

wherein the drawer mount attaches to the pedestal mount;

wherein the drawer mount comprises a dm housing, a dm plate, and a plurality of worm drives;

wherein the dm plate and the plurality of worm drives attach to the dm housing;

wherein the dm plate mounts on the dm housing;

wherein the dm housing is formed with a plurality of apertures and form factors for the operation of the plurality of worm drives;

wherein the dm housing physically attaches to the pedestal mount;

wherein the dm housing permanently attaches the dm plate and the plurality of worm drives to the pedestal mount;

wherein the dm plate is a rigid structure;

wherein the dm plate has the shape of an i-beam;

wherein the dm plate secures the decorative face to the drawer mount;

wherein the dm plate physically attaches to each worm drive selected from the plurality of worm drives;

wherein the plurality of worm drives attach to the dm plate;

wherein the plurality of worm drives adjust the position of the dm plate relative to the dm housing;

wherein the position of the decorative face relative to the drawer pan adjusts by adjusting the position of the dm plate relative to the dm housing.

2. The adjustable mounting bracket for drawer faces according to claim 1 wherein the adjustable mounting bracket for drawer faces is configured for use with a drawer pan;

wherein the adjustable mounting bracket for drawer faces secures a decorative face to a lateral face of the drawer pan;

wherein the adjustable mounting bracket for drawer faces forms a jig that adjusts the attachment position of the decorative face on the lateral face of the drawer pan;

wherein the adjustable mounting bracket for drawer faces adjusts the decorative face in the lateral and vertical directions.

3. The adjustable mounting bracket for drawer faces according to claim 2 wherein the pedestal mount secures the drawer mount to the drawer pan;

wherein the drawer mount secures the decorative face to the lateral face of the drawer pan.

4. The adjustable mounting bracket for drawer faces according to claim 3 wherein the drawer pan is a prism shaped structure;

wherein the drawer pan has a pan shape;

wherein the drawer pan forms a containment space used for the storage of one or more domestic articles.

5. The adjustable mounting bracket for drawer faces according to claim 4 wherein the decorative face is a decorative structure;

wherein the decorative face attaches to the lateral face of the pan shape of the drawer pan that is proximal to the opening of the drawer box when the drawer pan is fully inserted into the drawer box.

6. The adjustable mounting bracket for drawer faces according to claim 5 wherein the pedestal mount is a fastening device;

wherein the pedestal mount is a load bearing device;

wherein the pedestal mount physically attaches the drawer mount to the drawer pan;

wherein the pedestal mount permanently attaches to the drawer pan;

wherein the drawer mount permanently attaches to the pedestal mount.

7. The adjustable mounting bracket for drawer faces according to claim 6 wherein the drawer mount is a fastening device;

wherein the drawer mount secures the decorative face to the lateral face of the drawer pan that leads the drawer pan out of a drawer box when the drawer pan is removed from the drawer box.

8. The adjustable mounting bracket for drawer faces according to claim 7 wherein the drawer mount is an adjustable structure;

wherein by adjustable structure is meant that that the position of the decorative face relative to the drawer pan can be adjusted in a vertical direction after the drawer mount has attached the decorative face to the drawer pan;

wherein by adjustable structure is further meant that that the position of the decorative face relative to the drawer pan can be adjusted in a lateral direction after the drawer mount has attached the decorative face to the drawer pan.

9. The adjustable mounting bracket for drawer faces according to claim 8 wherein the dm housing is a prism shaped structure;

wherein the dm housing is a rigid structure;

wherein the dm housing is a hollow structure;

wherein the dm housing contains the plurality of worm drives.

10. The adjustable mounting bracket for drawer faces according to claim 9 wherein each worm drive selected from the plurality of worm drives is a worm drive;

wherein each selected worm drive attaches to an interior flange of the dm plate;

wherein each selected worm drive attaches to the interior flange such that the position of the interior flange relative to the dm housing is adjustable;

wherein the plurality of worm drives provide the motive forces necessary to change the position of the dm plate relative to the dm housing;

wherein the plurality of worm drives form the mechanical structure used to adjust the position of the decorative face relative to the drawer pan;

wherein the plurality of worm drives adjust the position of the decorative face by adjusting the position of the dm plate relative to the dm housing.

11. The adjustable mounting bracket for drawer faces according to claim 10 wherein the plurality of worm drives further comprises a vertical worm drive and a lateral worm drive;

wherein the vertical worm drive is a worm drive;

wherein the vertical worm drive is the worm drive selected from the plurality of worm drives that moves the decorative face relative to the drawer pan in the vertical direction;

wherein the vertical worm drive moves the decorative face by moving the dm plate relative to the dm housing;

wherein the lateral worm drive is a worm drive;

wherein the lateral worm drive is the worm drive selected from the plurality of worm drives that moves the decorative face relative to the drawer pan in the lateral direction;

wherein the lateral worm drive moves the decorative face by moving the dm plate relative to the dm housing.

12. The adjustable mounting bracket for drawer faces according to claim 11 wherein the dm housing further comprises a flange aperture and a containment space;

wherein the flange aperture is an aperture that is formed through the exterior surface of the dm housing;

wherein the dm plate attaches to the dm housing by inserting through the flange aperture;

wherein the flange aperture is sized such that the position of the dm plate within the flange aperture is adjustable;

wherein the containment space is a negative space that is formed within the dm housing;

wherein the containment space contains the plurality of worm drives within the dm housing;

wherein the containment space contains a portion of the dm plate within the dm housing.

13. The adjustable mounting bracket for drawer faces according to claim 12 wherein the dm plate further comprises an exterior flange, a web, and an interior flange;

wherein the exterior flange is a disk shaped structure;

wherein the exterior flange forms a flange of the i-beam structure of the dm plate;

wherein the exterior flange forms the structure of the dm plate that extends beyond the exterior surfaces of the dm housing;

wherein the exterior flange physically attaches to the decorative face;

wherein the surface area of the faces of the disk structure of the exterior flange is greater than the surface area of the flange aperture such that the exterior flange will not pass through the flange aperture into the containment space;

wherein the interior flange is a disk shaped structure;

wherein the interior flange forms a flange of the i-beam structure of the dm plate;

wherein the interior flange forms the structure of the dm plate that is contained within the containment space of the dm housing;

wherein the plurality of worm drives physically attach to the interior flange;

wherein each worm drive selected from the plurality of worm drives physically moves the interior flange to move the position of the dm plate relative to the dm housing;

wherein the surface area of the faces of the disk structure of the interior flange is greater than the surface area of the flange aperture such that the exterior flange will not pass out of the dm housing through the flange aperture;

wherein the web is a rigid structure that attaches the exterior flange to the interior flange;

wherein the web inserts through the flange aperture of the dm housing;

wherein the web transfers the motion of the interior flange to move the position of the exterior flange relative to the dm housing;

wherein the area of the cross section of the web is lesser than the surface area of the flange aperture such that the web moves freely within the flange aperture.

14. The adjustable mounting bracket for drawer faces according to claim 13 wherein the vertical worm drive further comprises a vertical drive plate and a vertical rotating drive cylinder;

wherein the vertical drive plate is a toothed structure;

wherein the vertical drive plate is a disk shaped structure that is formed with a gear structure;

wherein the vertical drive plate mounts on the congruent end of the disk structure of the interior flange that is distal from the exterior flange;

wherein the vertical rotating drive cylinder is a prism shaped structure;

wherein the vertical rotating drive cylinder has a cylindrical shape;

wherein the vertical rotating drive cylinder is a rotating structure;

wherein the vertical rotating drive cylinder rotates around a center of rotation that aligns with the center axis of the cylinder structure of the vertical rotating drive cylinder;

wherein the vertical rotating drive cylinder is manually rotated using a screwdriver;

wherein the vertical rotating drive cylinder further comprises an exterior gear structure that is formed on the lateral face of the cylindrical structure of the vertical rotating drive cylinder;

wherein the exterior gear structure of the vertical rotating drive cylinder meshes with the gear structure of the vertical drive plate such that the rotation of the vertical rotating drive cylinder moves the position of the vertical drive plate relative to the vertical rotating drive cylinder;

wherein the rotation of the vertical rotating drive cylinder moves the vertical drive plate which in turn moves the position of the dm plate within the flange aperture.

15. The adjustable mounting bracket for drawer faces according to claim 14 wherein the lateral worm drive further comprises a lateral drive plate and a lateral rotating drive cylinder;

wherein the lateral drive plate is a toothed structure;

wherein the lateral drive plate is a disk shaped structure that is formed with a gear structure;

wherein the lateral drive plate mounts on the congruent end of the disk structure of the interior flange that is distal from the exterior flange;

wherein the lateral rotating drive cylinder is a prism shaped structure;

wherein the lateral rotating drive cylinder has a cylindrical shape;

wherein the lateral rotating drive cylinder is a rotating structure;

wherein the lateral rotating drive cylinder rotates around a center of rotation that aligns with the center axis of the cylinder structure of the lateral rotating drive cylinder;

wherein the lateral rotating drive cylinder is manually rotated using a screwdriver;

wherein the lateral rotating drive cylinder further comprises an exterior gear structure that is formed on the lateral face of the cylindrical structure of the lateral rotating drive cylinder;

wherein the exterior gear structure of the lateral rotating drive cylinder meshes with the gear structure of the lateral drive plate such that the rotation of the lateral rotating drive cylinder moves the position of the lateral drive plate relative to the lateral rotating drive cylinder;

wherein the rotation of the lateral rotating drive cylinder moves the lateral drive plate which in turn moves the position of the dm plate within the flange aperture.

* * * * *